US005617617A

United States Patent [19]

Gustin

[11] Patent Number: 5,617,617

[45] Date of Patent: Apr. 8, 1997

[54] FABRIC COVER FOR A SEATBELT BUCKLE

[76] Inventor: Tom E. Gustin, 6101 Imperata St. NE. #2021, Albuquerque, N.M. 87111

[21] Appl. No.: 638,821

[22] Filed: Apr. 29, 1996

[51] Int. Cl.[6] ..... A44B 11/00

[52] U.S. Cl. ..... 24/633; 24/573.1; 297/482

[58] Field of Search ..... 24/633, 634, 573.1; 297/482; 280/801.1

[56] References Cited

U.S. PATENT DOCUMENTS

| | | | |
|---|---|---|---|
| 4,675,954 | 6/1987 | Gullickson | 24/633 |
| 4,901,407 | 2/1990 | Pondola et al. | 24/633 |
| 4,944,530 | 7/1990 | Spurrier | 297/482 |
| 4,961,251 | 10/1990 | Smith | 24/634 |
| 5,307,544 | 5/1994 | Quarberg et al. | 24/633 |
| 5,442,840 | 8/1995 | Ewald | 24/633 |

*Primary Examiner*—Victor N. Sakran

[57] ABSTRACT

The present invention relates to a supplemental seatbelt buckle cover system. The seatbelt buckle cover of the present invention is adapted to be removably positioned over a seatbelt buckle to protect a user from such a seatbelt buckle which may have inadvertently heated while in an automobile. In its broadest context, the cover includes a upper open end, a lower open end, a first open side and a second open side, as well as a slot positioned along the rearward wall of the cover. The slot allows the cover to be positioned over the shoulderbelt of a seatbelt or, in the alternative, the lapbelt of a seatbelt, rotated 90 degrees and slid onto the seatbelt buckle. Two springs are positioned within the opened first and second sides of the cover to allow the cover to be resiliently positioned and securely maintained upon the seatbelt buckle.

5 Claims, 3 Drawing Sheets

FABRIC COVER FOR A SEATBELT BUCKLE

BACKGROUND OF THE INVENTION

1. Field of the Invention

The present invention relates to a fabric cover for a seatbelt buckle and, more particularly, pertains to a fabric cover for a seatbelt buckle with resilient springs.

2. Description of the Prior Art

The use of seatbelt buckle anchor covers are known in the prior art. More specifically, seatbelt buckle anchor covers heretofore devised and utilized for the purpose of telescoping cover for a seatbelt buckle anchor are known to consist basically of familiar, expected and obvious structural configurations, notwithstanding the myriad of designs encompassed by the crowded prior art which have been developed for the fulfillment of countless objectives and requirements.

By way of example, the prior art in U.S. Pat. No. 4,368,563 to Lentz illustrates a seatbelt buckle with a plastic cover. U.S. Pat. No. 4,944,530 to Spurrier discloses a vehicle seatbelt metal buckle temperature insulating cover. U.S. Pat. No. 5,098,162 to Forgettetal discloses a seatbelt anchor cover. U.S. Pat. No. 3,605,209 to Alarcion discloses a safety belt buckle. U.S. Pat. No. 4,060,878 to Duiki discloses a buckle switch. U.S. Pat. No. 4,128,924 to Happel et al., discloses a laminated seatbelt buckle.

In this respect, the fabric cover for a seatbelt buckle according to the present invention substantially departs from the conventional concepts and designs of the prior art, and in so doing provides an apparatus primarily developed for the purpose of fabric cover for a seatbelt buckle with resilient springs.

Therefore, it can be appreciated that there exists a continuing need for new and improved fabric cover for a seatbelt buckle which can be used for fabric cover for a seatbelt buckle with resilient springs. In this regard, the present invention substantially fulfills this need.

SUMMARY OF THE INVENTION

In view of the foregoing disadvantages inherent in the known types of seatbelt buckle anchor covers now present in the prior art, the present invention provides an improved fabric cover for a seatbelt buckle. As such, the general purpose of the present invention, which will be described subsequently in greater detail, is to provide a new and improved fabric cover for a seatbelt buckle apparatus and method which has all the advantages of the prior art and none of the disadvantages.

To attain this, the present invention essentially comprises a supplemental seatbelt buckle cover system adapted to be removably positioned over a seatbelt buckle, comprising, in combination, a lapbelt. The lapbelt has a first end, a second end and an intermediate extent therebetween. A shoulderbelt is also provided and has a first end, a second and an intermediate extent therebetween. A metallic male buckle housing is provided and has an upper extent, a lower extent, a rearward extent and a forward extent. The first end of the lapbelt and the first end of the shoulderbelt are secured to the rearward extent of the male buckle housing. A male buckle has a first end, a second end and an intermediate extent therebetween. An aperture is formed within the intermediate extent. The first end of the male buckle is secured to the forward extent of the buckle housing. A rectangular buckle housing cover is constructed of a lightweight plastic with a fabric covering. The cover has an upper open end, a lower open end, a first open side, a second open side, a back side with a central extent and a front side. A slot is formed along the central of the back side. The slot is adapted to receive the shoulderbelt. A first S-shaped resilient spring has an upper end secured to the first open side adjacent the upper open end of the cover such that the first S-shaped resilient spring is positioned within the first open side of the cover. A second S-shaped resilient spring has an upper end secured to the second open side of the cover adjacent the upper open end of the cover such that the second S-shaped resilient spring is positioned within the second open side of the cover.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements Of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved fabric cover for a seatbelt buckle which has all the advantages of the prior art seatbelt buckle anchor covers and none of the disadvantages.

It is another object of the present invention to provide a new and improved fabric cover for a seatbelt buckle which may be easily and efficiently manufactured and marketed.

It is a further object of the present invention to provide a new and improved fabric cover for a seatbelt buckle which is of a durable and reliable construction.

An even further object of the present invention is to provide a new and improved fabric cover for a seatbelt buckle which is susceptible of a low cost of manufacture with regard to both materials and labor, and which accordingly is then susceptible of low prices of sale to the consuming public, thereby making such seatbelt buckle anchor covers economically available to the buying public.

Still yet another object of the present invention is to provide a new and improved fabric cover for a seatbelt buckle which provides in the apparatuses and methods of the prior art some of the advantages thereof, while simultaneously overcoming some of the disadvantages normally associated therewith.

Still another object of the present invention is to fabric cover for a seatbelt buckle with resilient springs.

Lastly, it is an object of the present invention to provide a supplemental seatbelt buckle cover system. The seatbelt buckle cover of the present invention is adapted to be removably positioned over a seatbelt buckle to protect a user from such a seatbelt buckle which may have inadvertently heated while in an automobile. In its broadest context, the cover includes a upper open end, a lower open end, a first open side and a second open side, as well as a slot positioned along the rearward wall of the cover. The slot allows the cover to be positioned over the shoulderbelt of a seatbelt or, in the alternative, the lapbelt of a seatbelt, rotated 90 degrees and slid onto the seatbelt buckle. Two springs are positioned within the opened first and second sides of the cover to allow the cover to be resiliently positioned and securely maintained upon the seatbelt buckle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
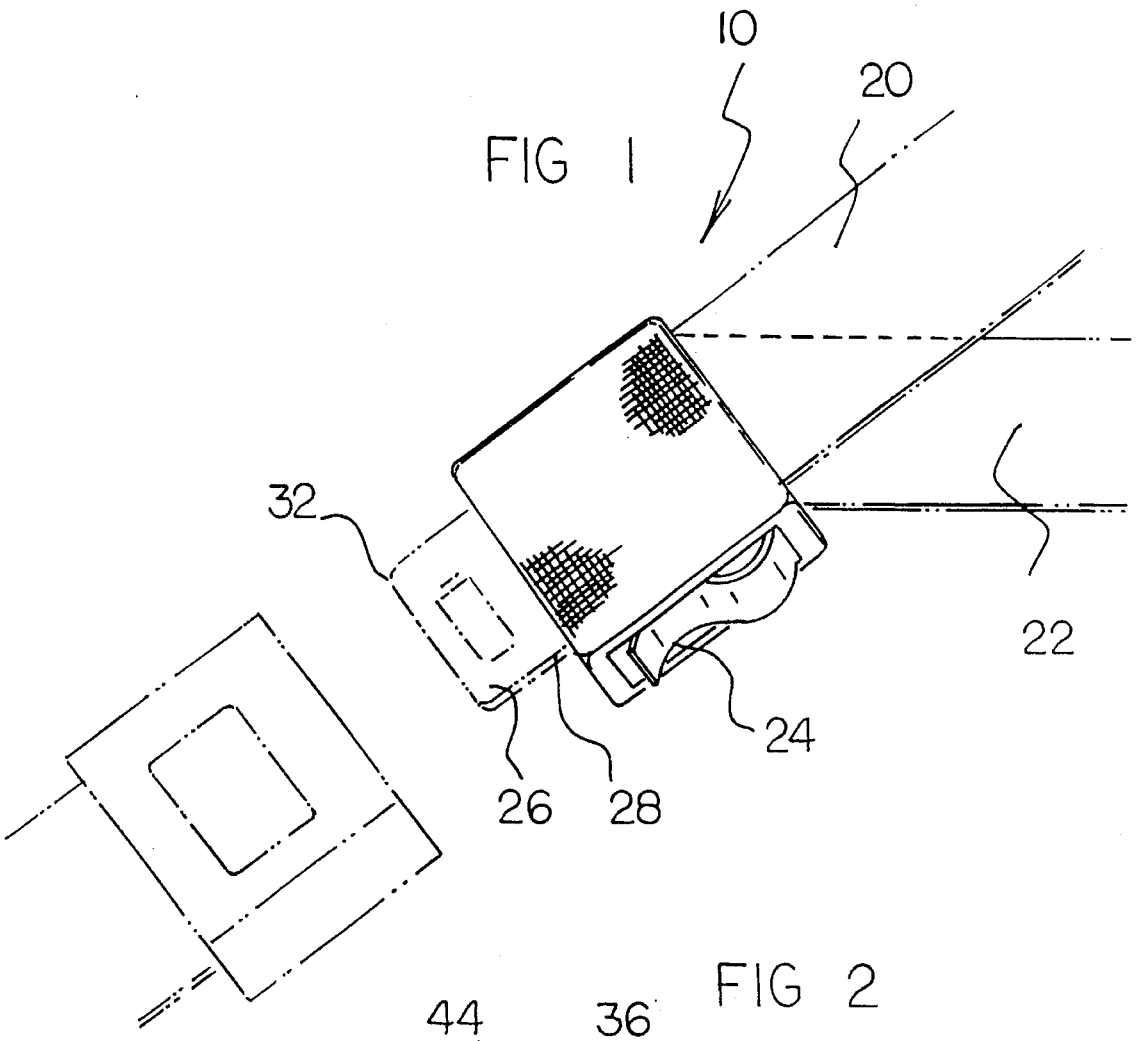
FIG. 1 is an illustration of the preferred embodiment of the fabric cover for a seatbelt buckle constructed in accordance with the principles of the present invention.
Figure 2:
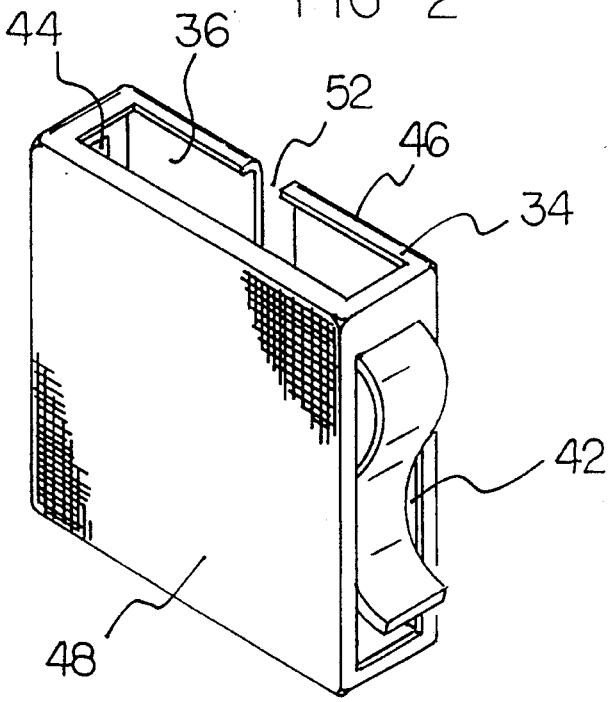
FIG. 2 is a perspective illustration of the cover in accordance with the present invention.
Figure 3:
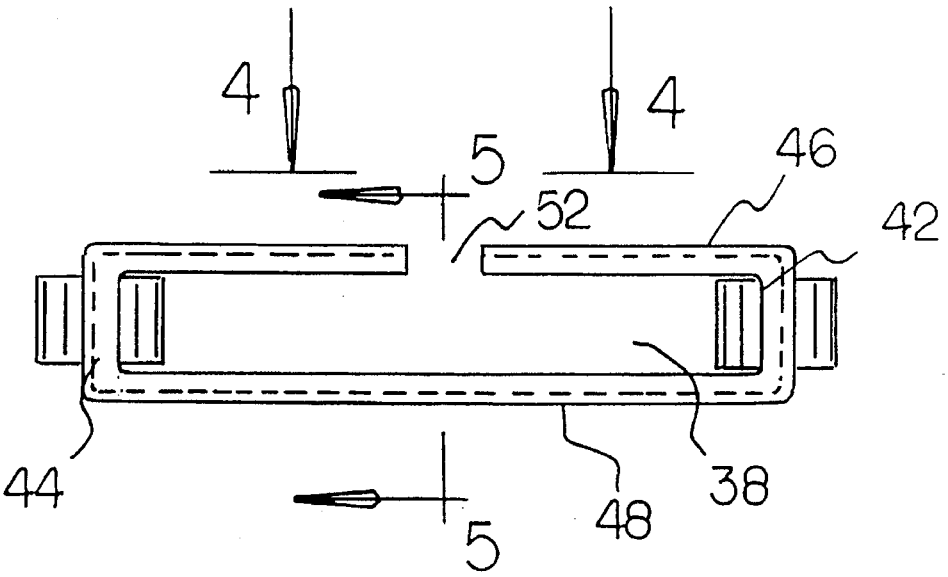
FIG. 3 is a perspective view of the seatbelt buckle cover in accordance with the present invention.
Figure 4:
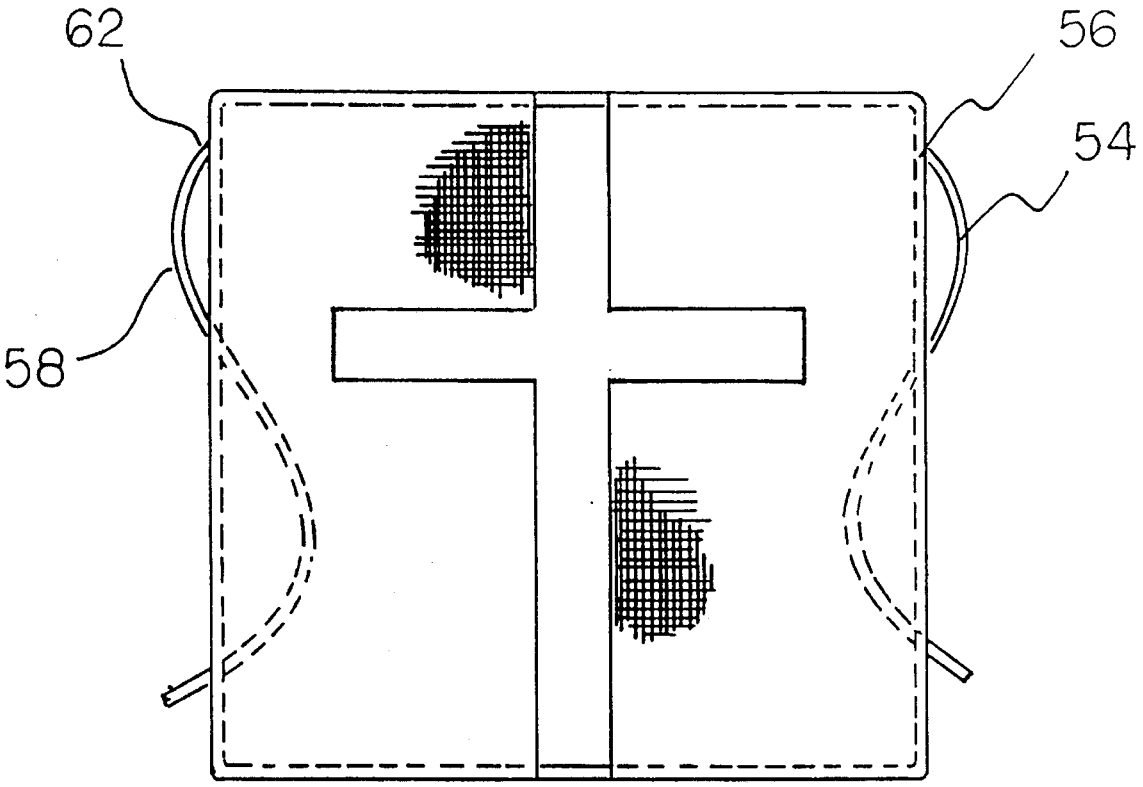
FIG. 4 is a view taken along line 4—4 of FIG. 3.
Figure 5:
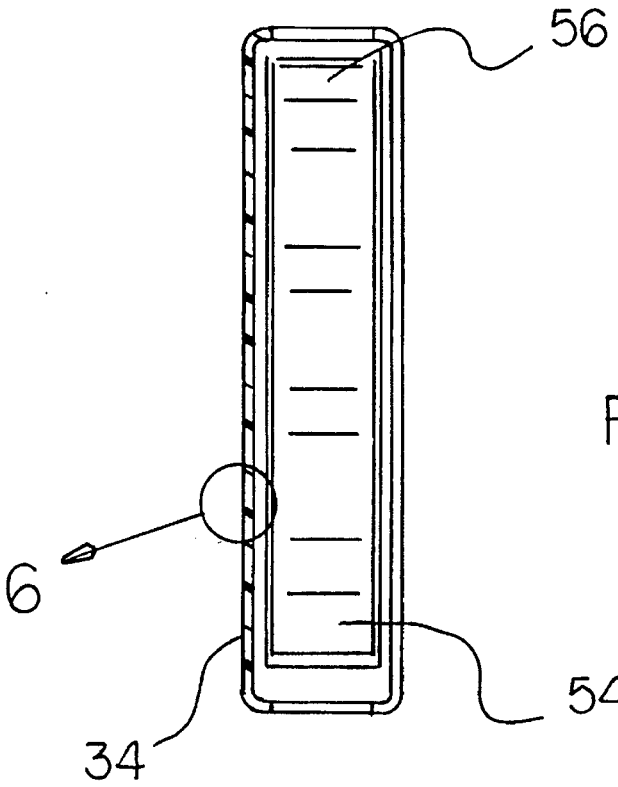
FIG. 5 is a view taken along line 5—5 of FIG. 3.
Figure 6:
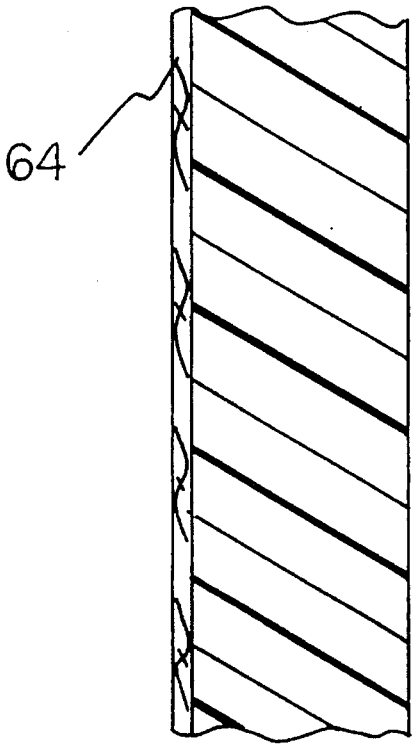
FIG. 6 is a detailed view taken from FIG. 5.

With reference now to the drawings, and in particular to FIG. 1 thereof, a new and improved fabric cover for a seatbelt buckle embodying the principles and concepts of the present invention and generally designated by the reference numeral 10 will be described.

The present invention relates to a supplemental seatbelt buckle cover system. The seatbelt buckle cover of the present invention is adapted to be removably positioned over a seatbelt buckle to protect a user from such a seatbelt buckle which may have inadvertently heated while in an automobile. In its broadest context, the cover includes a upper open end, a lower open end, a first open side and a second open side, as well as a slot positioned along the rearward wall of the cover. The slot allows the cover to be positioned over the shoulderbelt of a seatbelt or, in the alternative, the lapbelt of a seatbelt, rotated 90 degrees and slid onto the seatbelt buckle. Two springs are positioned within the opened first and second sides of the cover to allow the cover to be resiliently positioned and securely maintained upon the seatbelt buckle. The various components of the present invention, and the manner in which they interrelate, will be described in greater detail hereinafter.

The system 10 of the present invention includes the entire seatbelt apparatus with which the cover is to be used. More specifically, a lapbelt 20 which is defined by a first end, a second end and an intermediate extent therebetween. Furthermore, the system includes a shoulderbelt 22 which is also defined by a first end, a second and an intermediate extent therebetween. The lapbelt 20 and the shoulderbelt 22 can most clearly be seen in FIG. 1. The system also includes a metallic male buckle housing 24 which is defined by an upper extent, a lower extent, a rearward extent and a forward extent. This male buckle housing 24 oftentimes becomes inadvertently heated while it is sitting in an unattended vehicle. Furthermore, as can be seen in FIG. 1, the first end of the lapbelt 20 and the first end of the shoulderbelt 22 are secured to the rearward extent of the male buckle housing 24.

A male buckle 26 is associated with the male buckle housing 24. The male buckle has a first end 28 and a second end 32 with an intermediate extent therebetween. As can be seen in FIG. 1, an aperture is formed within the intermediate extent of the male buckle 26. Furthermore, the first end 28 of the male buckle 26 is secured to the forward extent of the male buckle housing 24. The male buckle 24 is adapted to be inserted within the female buckle portion of the seatbelt system. Thus, a user who is securing the seatbelt about them, has to grasp the male buckle housing 24 in order to insert the male buckle portion 26 within the female buckle portion of the system.

The buckle housing cover 34 is adapted to be inserted over the male buckle housing 24 to protect a user who is grasping this housing. In the preferred embodiment, the buckle housing 34 is constructed in a rectangular configuration. Furthermore, in the preferred embodiment, the cover, 34 is constructed from a lightweight plastic material. Additionally, a fabric, or other such covering, can be positioned over this lightweight plastic. Although a fabric covering has been described, other coverings would suffice. Specifically, a fur cover would also suffice. A main criteria for the construction of the cover 34 is that the material selected is not able to conduct heat. The cover 34 is defined by an upper open end 36, a lower open end 38, a first open side 42 and a second open side 44. Additionally, the cover 34 is defined by a backside 46 with a central extent and a front side 48. A slot 52 is formed along the central extent of the backside 46 of the cover 34. This slot enables the cover to be inserted onto a lapbelt and/or shoulderbelt in a manner to secure the cover 34 over the housing 24. Additionally, as depicted in FIG. 1, a horizontal slot is formed perpendicular to the slot 52. This horizontal slot facilitates the use of the cover with a combination lap and shoulder belt.

A first S-shaped resilient spring 54 is employed in securing the cover 34 over the male buckle housing 24. The S-shaped resilient spring 54 includes an upper end 56 which is secured to the first open side 42 of the cover 34 adjacent the upper open end 36. In this manner, the first S-shaped resilient spring 54 is positioned within the first open side 42 of the cover 34.

In a similar fashion, a second S-shaped resilient spring 58 is positioned within the second open side 44 of the cover 34. More specifically, an upper end 62 of the second S-shaped resilient spring 58 is secured to the second open side 44 adjacent the upper open end 36 Of the cover 34 such that the second S-shaped resilient spring 58 is positioned within the second open side 44.

Thus, in use, a user takes the cover 34 and by way of the slot 52 positions a lapbelt and/or shoulderbelt within the interior portion of the cover 34. At this time, the cover is positioned along the lap and/or shoulderbelt at a point distant from the housing 24. The user can then rotate the housing 90 degrees relative to the lapbelt and/or shoulderbelt to thus align the lower opening 38 with the rearward extent of the male buckle housing 24. The buckle housing cover 34 can then be slid down the lapbelt and/or shoulderbelt until the rearward extent of the male buckle housing 24 engages the lower open end 38 of the cover 34. Then the cover is urged fully over the male buckle housing 24. With the cover 34 securely in place, the first S-shaped spring 54 and the second S-shaped spring 58 are in firm engagement with the two sides of the male buckle housing 24. Thus, due to the non-heat conducting characteristics of the material of the cover 34, a user can grasp the male buckle housing 24 in the process of securing the seatbelt and not get burned due to an inadvertently heated male buckle housing 24.

Thus, the cover is made from a lightweight plastic with a fabric adhered to its exterior. The slot allows it to be slipped over the seatbelt, twist it and slid down to cover the buckle. Clips on either side are pressed in to grip the buckle to hold the cover ill place. The fabric cover could be produced in many styles to appeal to various customer groups. Furthermore, automotive company logos, sports team logos or other business advertisements could be imprinted on this cover for promotional reasons.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved supplemental seatbelt buckle cover system adapted to be removably positioned over a seatbelt buckle, comprising, in combination:

a lapbelt having a first end, a second end and an intermediate extent therebetween;

a shoulderbelt having a first end, a second and an intermediate extent therebetween;

a metallic male buckle housing having an upper extent, a lower extent, a rearward extent and a forward extent, the first end of the lapbelt and the first end of the shoulderbelt being secured to the rearward extent of the male buckle housing;

a male buckle having a first end, a second end and an intermediate extent therebetween, an aperture formed within the intermediate extent, the first end of the male buckle secured to the forward extent of the buckle housing;

a rectangular buckle housing cover constructed of a lightweight plastic with a fabric covering, the cover having an upper open end, a lower open end, a first open side, a second open side, a back side with a central extent and a front side, a slot formed along the central of the back side, the slot adapted to receive the shoulderbelt;

a first S-shaped resilient spring having an upper end secured to the first open side adjacent the upper open end of the cover such that the first S-shaped resilient spring is positioned within the first open side of the cover; and a second S-shaped resilient spring having an upper end secured to the second open side of the cover adjacent the upper open end of the cover such that the second S-shaped resilient spring is positioned within the second open side of the cover.

2. A supplemental seatbelt buckle cover system comprising:

a lapbelt having a first end, a second end and an intermediate extent therebetween;

a shoulderbelt having a first end, a second and an intermediate extent therebetween;

a metallic male buckle housing having an upper extent, a lower extent, a rearward extent and a forward extent, the first end of the lapbelt and the first end of the shoulderbelt being secured to the rearward extent of the male buckle housing;

a male buckle having a first end, a second end and an intermediate extent therebetween, the first end of the male buckle secured to the forward extent of the buckle housing;

a buckle housing cover, the cover having an upper open end, a lower open end, a first open side, a second open side, a back side with a central extent and a front side, a slot formed along the central of the back side, the slot adapted to receive the shoulderbelt;

a first resilient spring having an upper end secured to the first open side adjacent the upper open end of the cover such that the first resilient spring is positioned within the first open side of the cover; and a second resilient spring having an upper end secured to the second open side of the cover adjacent the upper open end of the cover such that the second resilient spring is positioned within the second open side of the cover.

3. The device as set forth in claim 2 wherein the buckle housing cover is constructed of a lightweight plastic with a fabric covering.

4. The device as set forth in claim 2 wherein the buckle housing cover is constructed in a rectangular configuration.

5. The device as set forth in claim 2 wherein the first and second resilient springs are S-shaped.

* * * * *